United States Patent [19]

Arfert et al.

[11] 4,263,800

[45] Apr. 28, 1981

[54] METHOD OF FORMING A NESTABLE CONTAINER

[75] Inventors: Horst F. Arfert, Midlothian; Edward D. Gardner; Charles H. Nicklies, both of Chesterfield County, all of Va.

[73] Assignee: Reynolds Metals Company, Richmond, Va.

[21] Appl. No.: 23,537

[22] Filed: Mar. 26, 1979

[51] Int. Cl.[3] ..... B21D 22/28

[52] U.S. Cl. ..... 72/349; 113/1 G; 113/120 H; 113/120 M

[58] Field of Search ..... 72/349, 348, 347, 344, 72/343; 113/120 M, 120 H, 1 G; 220/DIG. 22; 206/519, 520

[56] References Cited

U.S. PATENT DOCUMENTS

| | | | |
|---|---|---|---|
| 3,293,895 | 12/1966 | Kohan | 113/120 H |
| 3,422,984 | 1/1969 | Foster | 220/59 |
| 3,855,862 | 12/1974 | Moller | 113/120 H |
| 3,911,719 | 10/1975 | Degenhardt | 72/349 |
| 3,924,437 | 12/1975 | Hortig | 113/120 H |
| 4,049,122 | 9/1977 | Maxwell | 206/519 |
| 4,151,927 | 5/1979 | Cvacho | 220/66 |

*Primary Examiner*—Lowell A. Larson
*Assistant Examiner*—Gene P. Crosby
*Attorney, Agent, or Firm*—Glenn, Lyne, Girard & McDonald

[57] ABSTRACT

A method of forming a nestable and stackable drawn and ironed container is disclosed. The container is designed to permit a plurality of the containers to be stacked within one another to thereby permit transport of empty containers while occupying far less space than previously required for beverage containers.

4 Claims, 30 Drawing Figures

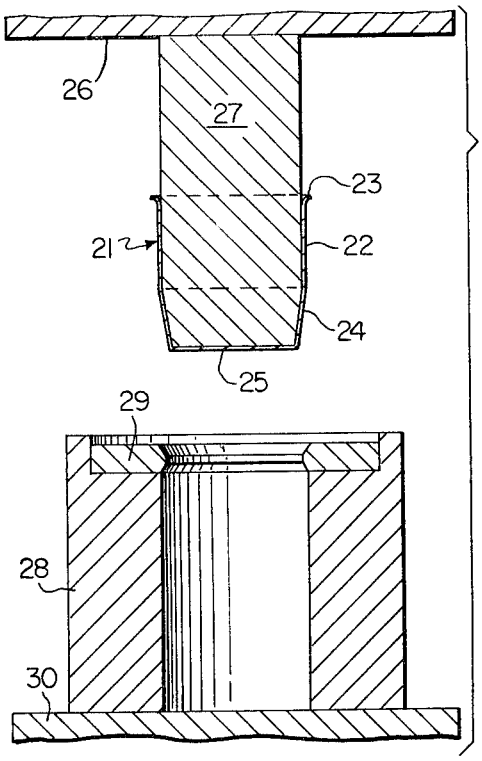
FIG. 5
FIG. 6
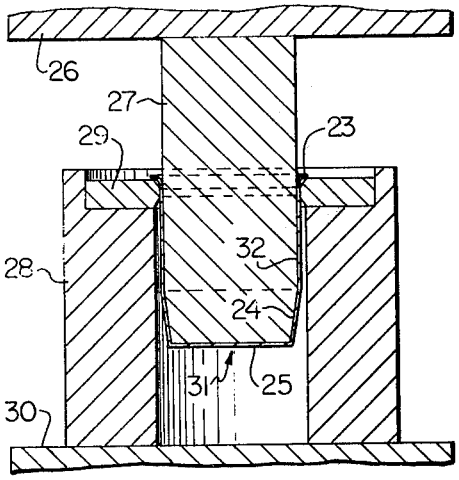
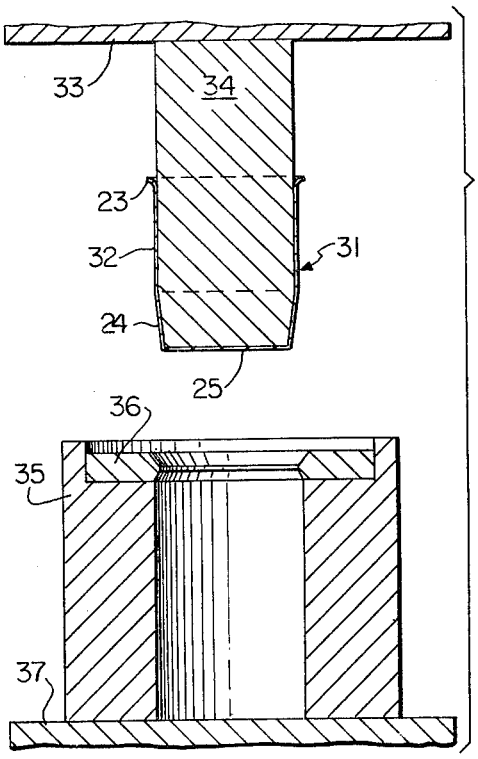
FIG. 7
FIG. 8
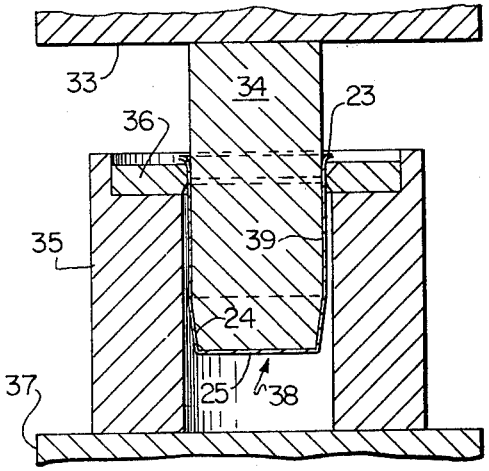

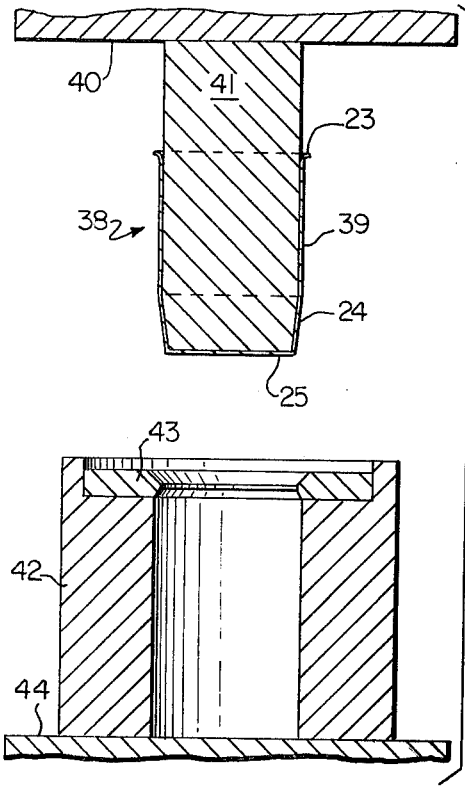
FIG. 9
FIG. 10
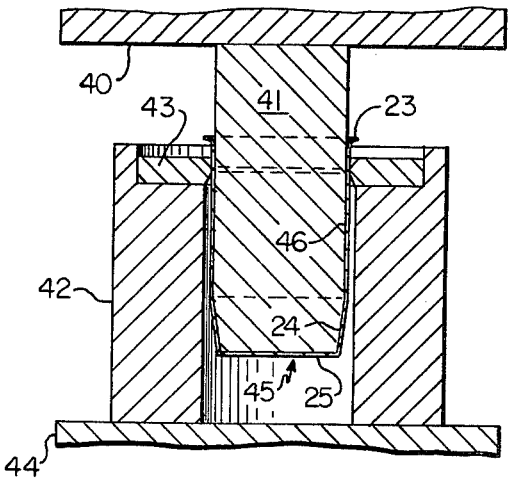
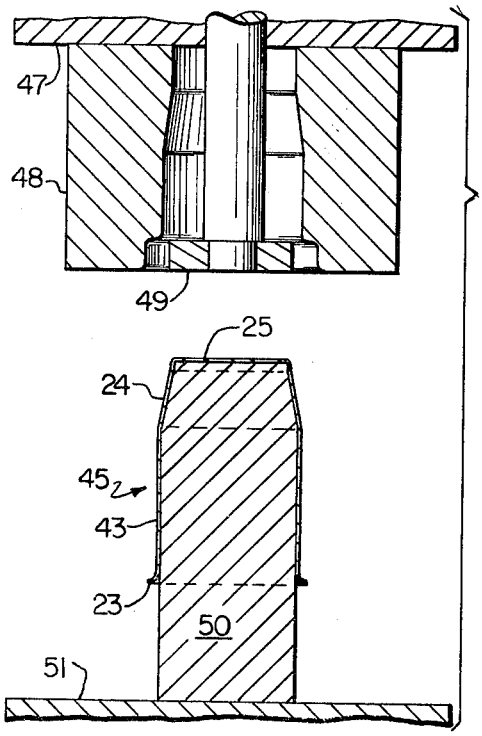
FIG. 11
FIG. 12
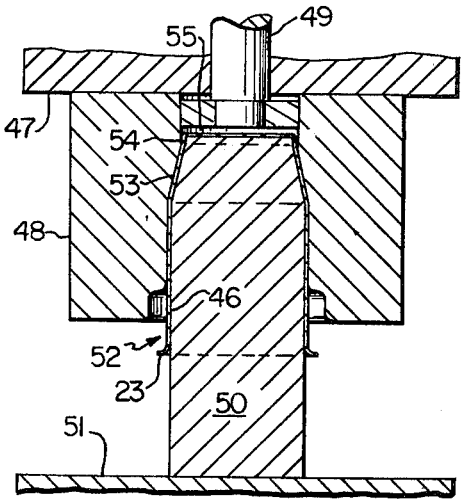

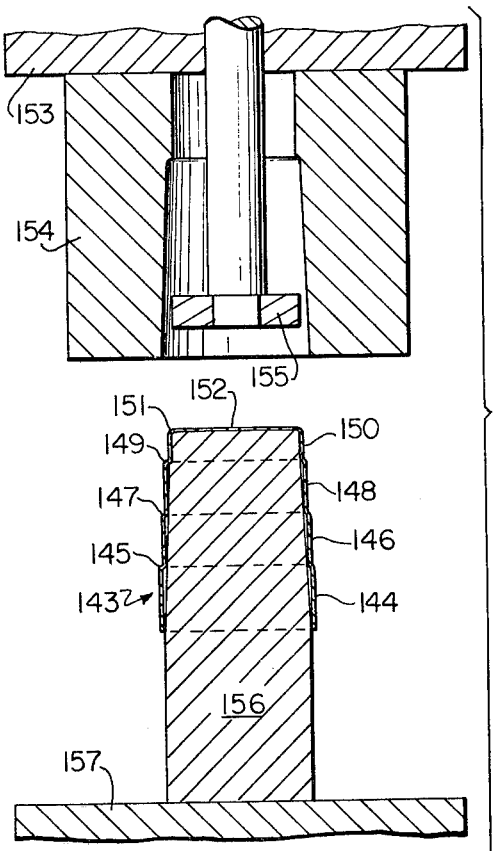
FIG. 27
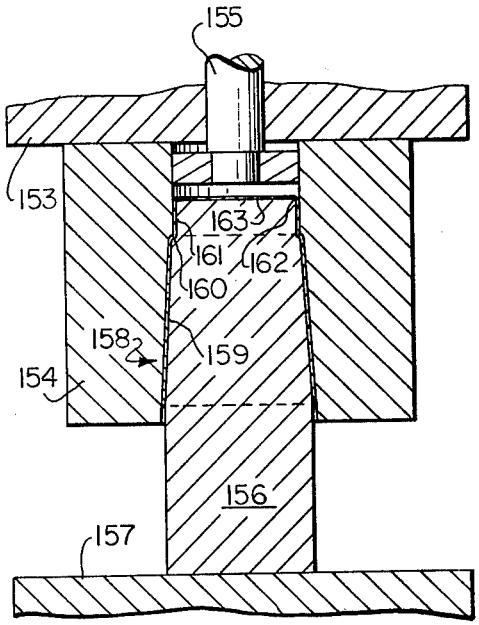
FIG. 28
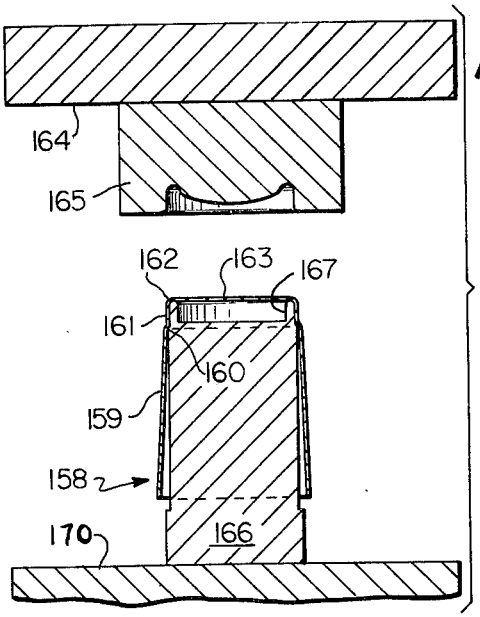
FIG. 29
FIG. 30
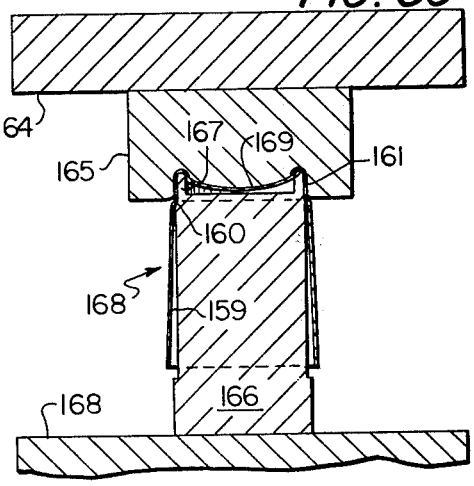

METHOD OF FORMING A NESTABLE CONTAINER

BACKGROUND OF THE INVENTION

Many beverages, such as soft drinks and beer, are packaged and transported in metallic cans. These cans, whether they be of the three-piece, seamed type or the two-piece, drawn and ironed type, are generally right cylindrical in shape.

In many circumstances, can bodies are produced by a can manufacturer and shipped to the soft drink producer or brewery where they are filled, sealed and distributed. Cylindrical cans are not nestable into one another. Thus, in transporting the empty cans from the can manufacturer to the beverage producer, the cans are stacked one upon another in vertical columns, taking up substantially an equal amount of space as do the filled cans. Clearly, much of this space is taken up by air.

Tapered containers, which may be nested into one another, are also known. Typically, molded plastic tumblers and glasses formed both of glass and metal are formed having tapered sides so that the containers may be stacked into one another, thus saving large amounts of space in storage during transport of the containers.

The drawn and ironed can forming process has now taken over 50% of the market for cans in the beverage field. However, a limitation in the known drawn and ironed process has required the cans formed by this process have a generally right cylindrical side wall profile, thus eliminating the possibility of a nestable container. It would be, therefore, advantageous to produce a nestable container by means of the drawn and ironed method. Such a can would have all of the advantages of a two-piece can; no seams are present, the entire side wall may be decorated and lightweight materials, such as aluminum, may be used. Such a container would also have the advantage of being able to be stacked or nested into one another during transport and storage of the empty containers, thus substantially reducing the storage space necessary for a given number of containers and substantially increasing the total number of containers which may be stored or transported in a given space volume.

THE PRESENT INVENTION

By means of the method of the present invention, such a nestable, drawn and ironed container is produced. The method of the present invention comprises the initial drawing of a blank of sheet material, such as steel, aluminous metal and the like, into a cup, ironing the side wall of this cup to lengthen and thin the side wall and reforming the side wall, such as by stuffing or the like, to form a tapered side wall. The initial drawing may be performed on a preformed, generally circular blank or may include cutting a blank from a strip of metallic sheet material. A contoured bottom profile may also be formed in the bottom wall of the container, either in a separate step or during either the ironing or reforming steps.

The container formed by means of the present invention may be necked and flanged to accept an end closure after filling. Preferably, the necking and flanging operation would be performed after transport of the container to the beverage producer, to take advantage of the stackability of the tapered container of the present invention during transit.

BRIEF DESCRIPTION OF THE DRAWINGS

The method of the present invention will now be more fully described with reference to the drawings of preferred embodiments thereof, in which:

FIGS. 5 and 6 illustrate a first ironing operation;

FIGS. 7 and 8 illustrate a second ironing operation;

FIGS. 9 and 10 illustrate a third ironing operation;

FIGS. 11 and 12 illustrate a first reforming operation;

FIGS. 27 and 28 illustrate a second reforming operation; and

FIGS. 29 and 30 illustrate a bottom contour forming operation.

DETAILED DESCRIPTION OF THE PREFERRED EMBODIMENTS

FIGS. 1–18 illustrate a first embodiment for forming a tapered container according to the method of the present invention. As will be noted throughout the description of the various FIGURES, combinations of multiple steps into fewer multiple steps or even into a single step, and elimination of certain steps may be accomplished, depending upon the type and thickness of metallic sheet material being employed and the specific design shape and size of the container to be produced.

Figure 1:
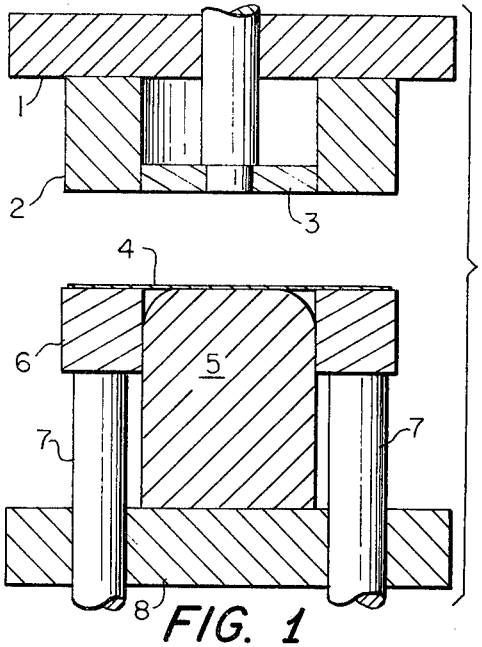
FIGS. 1 and 2 illustrate a first drawing operation.
Figure 2:
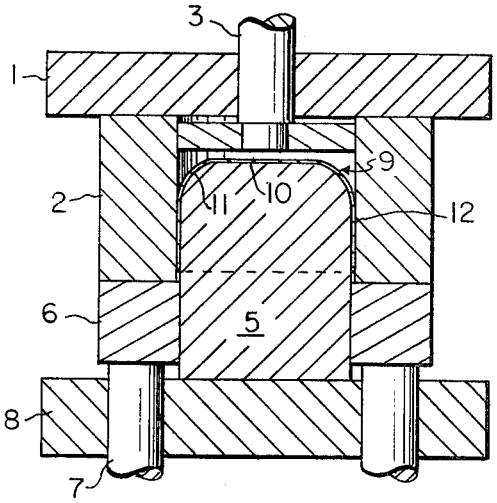

Turning now to FIGS. 1 and 2, the initial cup forming from a sheet of metallic material is illustrated. FIG. 1 illustrates a drawing press in its open position prior to formation of the cup. FIG. 2 illustrates the same drawing press in its closed position with the cup having been formed therein.

The drawing press includes an upper die set 1 having a female die 2 attached thereto. A knockout 3 is also illustrated within the female die 2. The operation of the knockout 3 will be more fully described below. A blank of metallic sheet material 4 is located on top of a draw ring 6. The blank of sheet material 4 is a generally circular blank, having a diameter of from about 4.5 to 6.0 inches (11.4 to 15.2 centimeters) and a thickness of from about 0.012 to 0.015 inches (0.030 to 0.038 centimeters). The blank 4 is formed of any of the typical metallic container forming materials, such as aluminous materials, tin-plated steel, tin-free steel and the like. While a preformed blank 4 is illustrated, a continuous sheet of metallic material may be employed, with the drawing press blanking the sheet into blanks 4 between the female die 2 and the draw ring 6, with the female die 2 being provided with a sharpened cutting edge. The draw ring 6 is mounted on a plurality of pins 7 which may travel in the vertical direction along their axis. A punch 5 is also located below the blank 4 and is mounted upon a lower die set 8. It should be noted that the dies as shown in FIGS. 1 and 2, as well as the various dies shown in the remaining FIGURES, may be oriented opposite to that illustrated, i.e., the lower members could be the upper members and the upper members could be the lower members, with the blank 4 then resting upon the female die 2. This will become more evident in the FIGURES to be described below, where the male and female die members are inverted.

As can be seen in FIG. 2, as the upper die set 1 is lowered, the female die 2 and draw ring 6 grasp the edge of the blank 4 to prevent wrinkling thereof during the drawing operation. The female die 2, draw ring 6 and pins 7 are lowered further, with the punch 5 remaining stationary. This causes the blank 4 to be drawn between the inner wall of the female die 2 and the outer surface of the punch 5 into a cup 9. The cup 9 includes a generally flat bottom portion 10, a curved or semi-toroidal transitional portion 11 and a generally cylindrical side wall 12.

After formation of the cup 9 is complete, upper die set 1 is raised and knockout 3 is lowered to force the cup 9 out of the female die 2.

Figure 3:
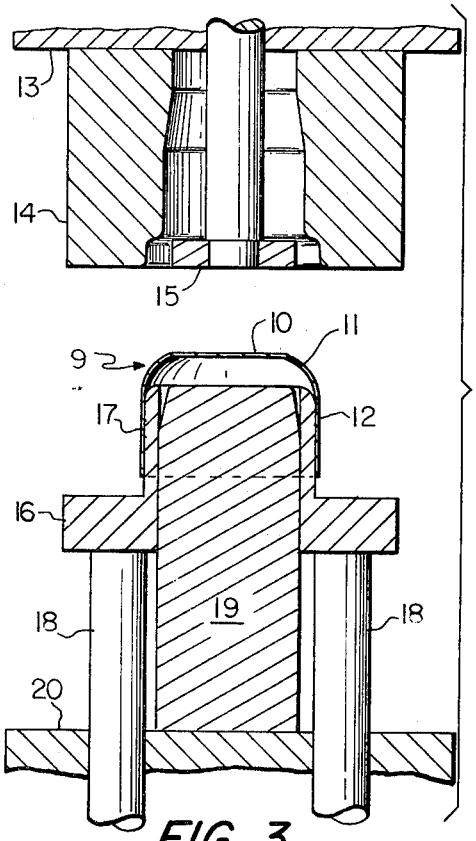
FIGS. 3 and 4 illustrate a second drawing operation.
Figure 4:
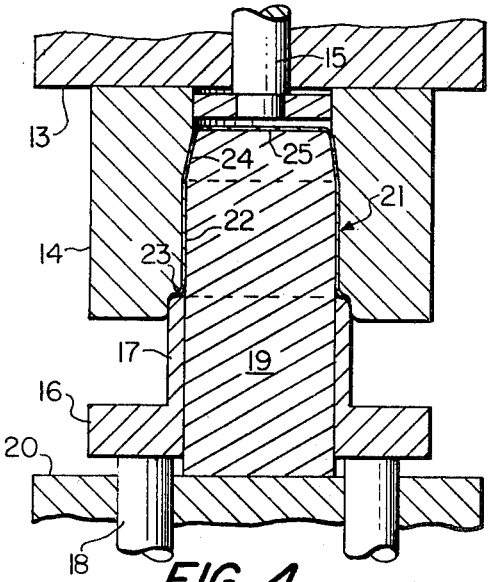

FIGS. 3 and 4 illustrate a second drawing operation. While the second drawing operation is illustrated as redrawing the cup 9 in the same direction as originally drawn, it should be clear to those skilled in the metal working art that the operation illustrated in FIGS. 3 and 4 may in actuality be a reverse redraw operation, with the cup 9 being redrawn such that its outer surface then becomes its inner surface and its inner surface then becomes its outer surface. It should also be clear that, with tooling designed in manners known to those skilled in the art, the drawing operation of FIGS. 1 and 2 and the redrawing operation of FIGS. 3 and 4, if performed as a reverse redraw operation, could be accomplished in a single step by providing a punch within female die 2 and a hollow punch and die combination replacing punch 5.

Now turning more carefully to FIGS. 3 and 4, an upper die set 13 has attached thereto a female die 14 and a knockout 15 is located within the female die 14. The cup 9, as formed in FIG. 2, is mounted on a locator 17 of a draw ring 16. The draw ring 16 is, in turn, mounted upon pins 18, which may move vertically along their axis as did the pins 7 in FIGS. 1 and 2. A punch 19 is attached to a lower die set 20. As the upper die set 13 is lowered, the locator 17 contacts the female die 14 while the punch 19 and the cup 9 enter the female die 14. As in FIGS. 1 and 2, the upper die set 13, the female die 14 and the draw ring 16 move downwardly so that the punch 19 and the cup 9 enter the female die 14 for a desired distance. This distance is controlled such that a flange 23 is formed in a cup 21 produced by this operation between the female die 14 and the locator 17. Such positioning results from the shape of the inner wall of the female die 14 and the outer surface of the locator 17.

The cup 21 produced by this step includes positioning results from the shape of the inner wall of the female die 14 and the outer surface of the locator 17.

The cup 21 produced by this step includes a generally flat bottom wall 25, a generally frustoconical transitional portion 24 and a generally cylindrical side wall 22.

Turning to FIGS. 5 and 6, a first side wall ironing operation is illustrated. In this operation, an upper die set 26 has a punch 27 attached thereto. Cup 21, as formed in FIG. 4, is located on the punch 27. A die holder 28 has an ironing die 29 mounted therein and is itself mounted upon a lower die set 30. The ironing die 29 is formed of a material which is not easily abraided by the material of which the cup 21 is formed. Typically, this ironing ring 29 is formed of a carbide material, such as tungsten carbide, silicon carbide or the like. As the upper die set 26 and the punch 27 are lowered, the side wall 22 of the cup 21 contacts the ironing ring 29. This contact thins the side wall 22 from the original thickness of the blank 4 and lengthens the side wall 22 to produce a generally cylindrical side wall 32. This side wall 32 may have a thickness in the range from about 0.009 to about 0.011 inches (0.022 to 0.028 centimeters).

It should be noted that the ironing operation illustrated in FIGS. 5 and 6 does not effect either the bottom wall 25 or the generally frusto-conical transitional portion 24. It should also be noted that the ironing operation does not reach the very top region of the side wall 22 and does not affect the flange 23.

FIGS. 7 and 8 illustrate a second ironing operation which is basically identical to the ironing operation illustrated in FIGS. 5 and 6. In this operation, a die set 33 and a punch 34, having container 31, as formed in FIG. 6, mounted thereon, are lowered into a die holder 35 having an ironing ring 36 mounted therein, with the die holder 35 being mounted on lower die set 37. As the side wall 32 of the container 31 contacts ironing ring 36, its thickness is again reduced and its length is again extended to form a container 38. The thickness of the side wall 39 may be from about 0.007 to about 0.009 inches (0.017 to 0.020 centimeters). Neither the bottom wall 25, the frustoconical transitional portion 24 nor the flange 23 are affected by this operation.

FIGS. 9 and 10 illustrate still another ironing operation in which an upper die set 40 is lowered to permit a punch 41 and the container 38, as formed in FIG. 8, to be lowered into a die holder 42 carried by a die set 44 and permit the side wall 39 of the container 38 to be ironed by ironing ring 43. Once again, the side wall 39 is reduced in thickness and extended in length to form a side wall 46 of a container 45 having a thickness from about 0.0045 to about 0.007 inches (0.011 to 0.017 centimeters). Once again, neither the bottom wall 25, the frustoconical transitional portion 24 nor the flange 23 are affected by this operation.

Once again, it should be noted that, depending upon the thickness of the metallic sheet material 4 from which the final container is to be formed, and depending upon the final size and shape of the final container to be produced, the ironing operations illustrated in FIGS. 5–10 may be reduced from three steps to two or even one step, as will be illustrated below. In contrast, if required, even further ironing steps beyond those illustrated may be performed.

FIGS. 11 and 12 illustrate a first reforming operation. As illustrated, this reforming operation is a stuffing operation. A female die 48 is mounted upon an upper die set 47, with a knockout 49 being located within the female die 48. Container 45, as formed in FIG. 10, is mounted upon a punch 50 which is in turn mounted upon lower die set 51. As the upper die set 47 and female die 48 are lowered upon the container 45 and punch 50, the container 45 is reformed into container 52. In this operation, the generally frustoconical transitional portion 24 and generally flat bottom closing portion 25 are reformed into a generally flat bottom closing portion 55, a generally cylindrical first transitional portion 54 and a generally frustoconical second transitional portion 53 attached to the side wall 46. The side wall 46 and the flange 23 are unaffected by this operation.

Figure 13:
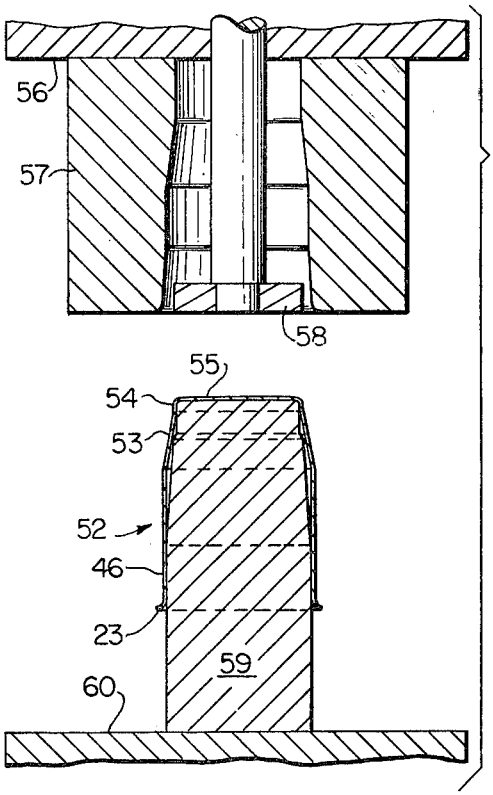
FIGS. 13 and 14 illustrate a second reforming operation.
Figure 14:
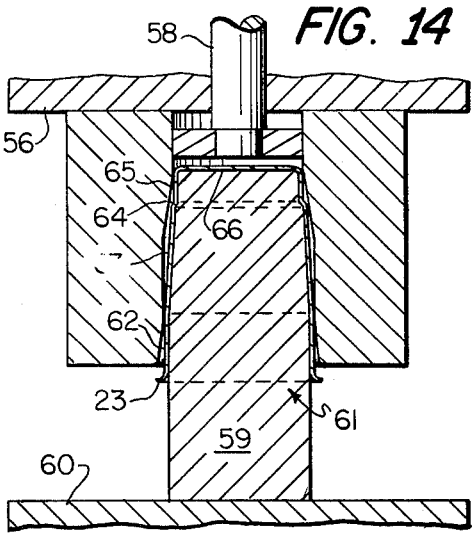

FIGS. 13 and 14 illustrate a second reforming or stuffing operation. In this operation, an upper die set 56 and associated female die 57, having knockout 58 located therein, are lowered upon the container 52 formed in FIG. 12 and a punch 59, which is attached to lower die set 60.

When upper die set 56 and female die 57 are lowered onto container 52 and punch 59, changes occur in the first transitional region 54, the second transitional region 53 and the side wall 46. As can be seen in FIG. 14, the now reformed container 61 has a generally flat bottom closing portion 66, a generally cylindrical transitional portion 65, which will be transformed below into a stacking ring, so that a plurality of finished containers can be stacked inside each other, a generally frustoconical transitional portion 64, a generally frustoconical side wall 63 and a cylindrical side wall 62 having flange 23 connected thereto. At this point, the tapered side wall desired has been partially formed and the stacking ring 65 has been partially formed.

Figure 15:
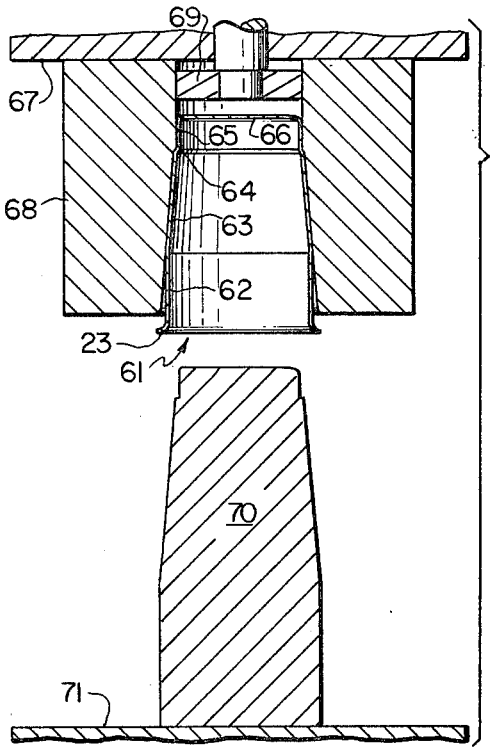
FIGS. 15 and 16 illustrate a third reforming operation.
Figure 16:
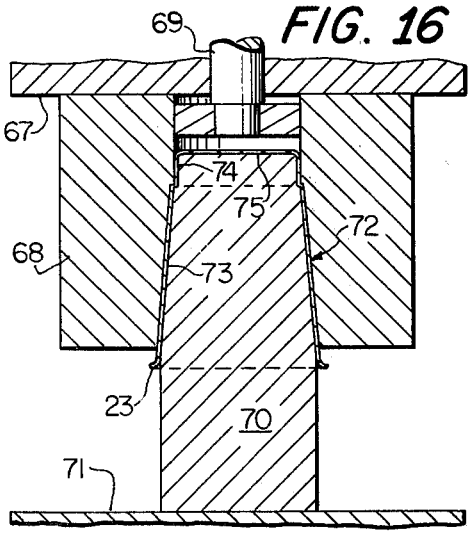

FIGS. 15 and 16 illustrate a third reforming or stuffing operation in which the final side wall taper is produced and the stacking ring 74 is finally formed. Also illustrated in these FIGURES is the placement of the container 61 in the female die, rather than mounted onto the punch, prior to the engagement of the punch and the female die. As previously mentioned, this could be done in any of the steps in which a punch and die are employed.

The container 61 formed in FIG. 14 is located within a female die 68, with the female die 68 being attached to an upper die set 67 which includes a knockout 69 located therein. A punch 70 is mounted on a lower die set 71. When the female die 68 and punch 70 are brought together, the frustoconical transitional portion 64, frustoconical sidewall portion 63 and cylindrical side wall portion 62 are reformed into a single generally frustoconical side wall 73 having cylindrical transitional portion 74 adjoining at one end thereof and flange 23 adjoining at the other end thereof, with the transitional portion 74 adjoining the bottom closing portion 75.

Similar to the separate ironing steps previously mentioned, it is apparent that the three separate reforming steps illustrated could be combined into two or even one reforming step, again based upon the size and shape of the ultimate container to be produced and upon the thickness of the metal being employed. Similarly, four or more reforming steps may be necessary, again depending upon the exact materials and dimensions for the container to be ultimately produced.

Figure 17:
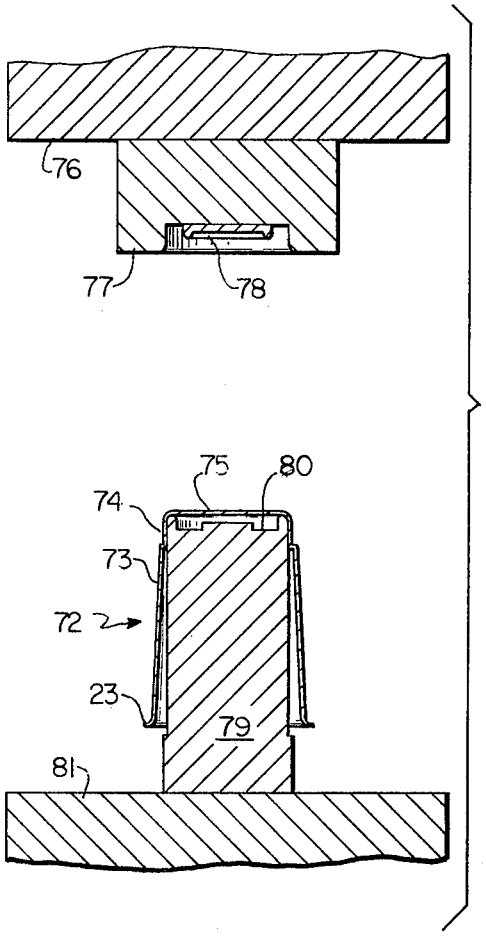
FIGS. 17 and 18 illustrate a bottom contour forming operation.
Figure 18:
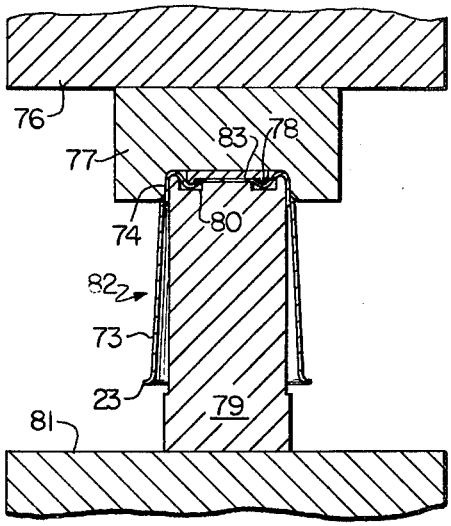

FIGS. 17 and 18 illustrate the formation of a countoured bottom profile for the container. An upper die set 76 has a locating ring 77 mounted thereon. A male bottom coutour former 78 is mounted upon the locating ring 77. This male bottom contour former 78 may be separate from and attached to the locating ring 77, or may be an integral portion thereof. The container 72, as formed in FIG. 16, is located upon a punch 79 having female bottom contour former 80 as an end thereof. The punch 79 is mounted upon a lower die set 81.

As the male and female bottom contour formers are brought together, bottom closing portion 75 is shaped to form profiled bottom closing portion 83.

The contour of bottom closing portion 83 may take any of numerous shapes. For example, this bottom shape could be the conventional "A" or "E" bottoms, or the "V-100" bottom as disclosed in U.S. Application Ser. No. 656,045, now Pat. No. 4,151,927, and 774,475, now Pat. No. 4,222,494, which are assigned to the assignee of the present invention and which are incorporated herein by reference.

It should be noted that the bottom forming operation could be combined with the reforming operation, rather than being a separate step, as illustrated. It should also be noted that a flat bottom may also be permitted in some circumstances, thus eliminating the need for a bottom contouring step.

Throughout the various drawing, ironing and reforming steps, suitable lubricants are employed, as is common in the formation of drawn and ironed cans. Thus, for example, such lubricants as water emulsifiable oils or synthetic oils may be employed.

The container 82 as finally formed still includes flange 23 and a small region therebelow which was not ironed by the ironing dies. Eventually, however, the flange 23 and the unironed region therebelow are removed. In trimming this region from the cans, the cans are necked and flanged, as is customary in can manufacturer, to accept a top closure in sealed relation thereon. This enclosure may have a ring pull end, a solid end, or any easy opening end such as the Stay-On-Tab closure as illustrated in U.S. Pat. No. 3,967,752, which is incorporated herein by reference.

If, however, the container 82 is produced in an integral container manufacture-beverage production facility, the flanged region 23 and the unironed region there below may be removed in line with the formation of the can 82, if the cans are to be immediately filled and not stored.

FIGS. 19 through 30 illustrate the formation of a tapered container by means of a modified method according to the present invention.

Figure 19:
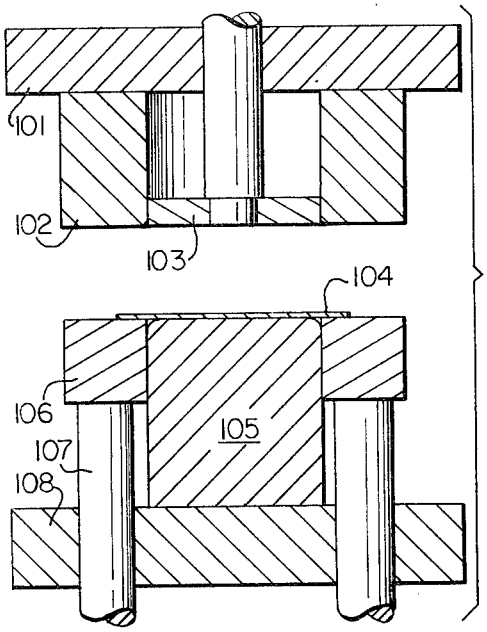
FIGS. 19 and 20 illustrate a first drawing operation in a modified embodiment of the present invention.
Figure 20:
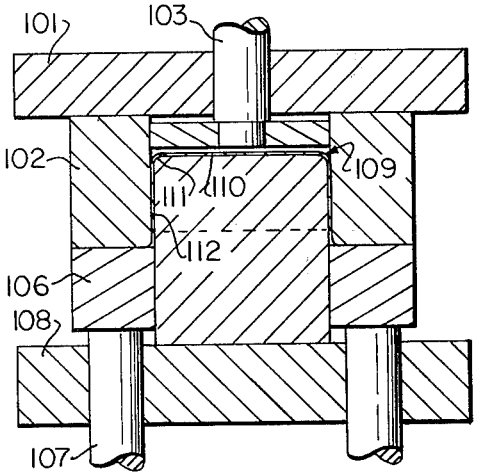

Turning now to FIGS. 19 and 20, the initial cup forming from a sheet of metallic material according to the modified method is illustrated. FIG. 19 illustrates a drawing press in its open position prior to formation of the cup. FIG. 20 illustrates the same drawing press in its closed position with the cup having been formed therein. These figures are similar to FIGS. 1 and 2, with the only modification being in the shape of the cup formed.

The drawing press includes an upper die set 101 having a female die 102 attached thereto. A knock out 103 is also illustrated within the female die 102. A blank of metallic material 104 is located on top of a draw ring 106. Similar to FIG. 1, the blank of sheet material 104 is a generally circular blank, having a diameter of from about 4.5 to 6.0 inches (11.4 to 15.2 centimeters) and a thickness of from about 0.012 to 0.015 inches (0.030 to 0.038 centimeters). As in the previous embodiment, the blank 104 is formed of any of the typical metallic container forming materials, such as aluminous materials, tin-plated steel, tin-free steel and the like. Again similar to the previous embodiment, while a preformed blank 104 is illustrated, a continous sheet of metallic material may be employed, with the drawing press blanking the sheet into blanks 104 between the female die 102 and draw ring 106, with the female die 102 being provided with a sharpened cutting edge. The draw ring 106 is mounted on a plurality of pins 107 which may travel in the vertical direction along their axis. A punch 105 is also located below the blank 104 and is mounted upon a lower die set 108. Once more in a similar matter with the previous embodiment, it should again be noted that the dies shown in FIGS. 19 and 20, as well as the various dies shown in the remaining FIGURES, may be oriented opposite to that illustrated, i.e., the lower members could be the upper members and the upper members could be the lower members, with the blank 104 resting upon the female die 102.

As illustrated in FIG. 20, as the die set 101 is lower, the female die 102 and draw ring 106 grasp the edge of the blank 104 to prevent wrinkling thereof during the drawing operation. The female die 102, draw ring 106 and pins 107 are lowered further, with the punch 105 remaining stationary. This causes the blank 104 to be drawn between the inner wall of the female die 102 and the outer surface of the punch 105 into a cup 109. The cup 109 includes a generally flat bottom portion 110, a curved or semi-torroidal transitional portion 110 and a generally cylindrical side wall 112. The cup 109 is similar in size and shape to the cup 9 formed in FIG. 2, but is somewhat shallower and of a somewhat larger diameter.

After formation of the cup 109 is complete, upper die set 101 is raised and knock out 103 is lowered to force the cup 109 out of the female die 102.

Figure 21:
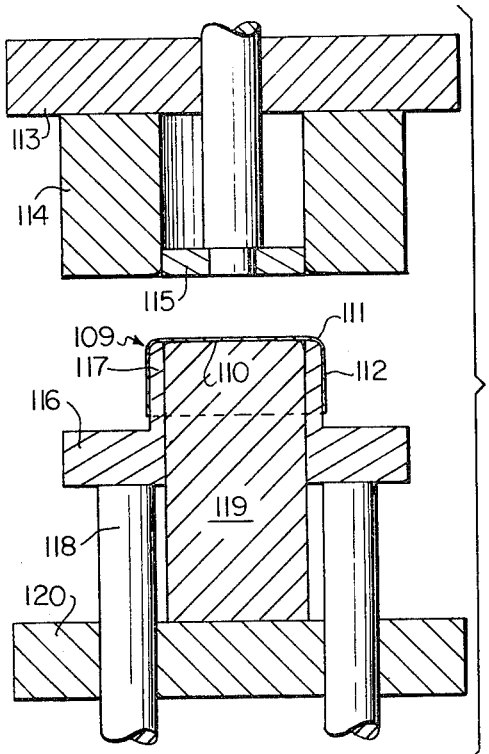
FIGS. 21 and 22 illustrate a second drawing operation.
Figure 22:
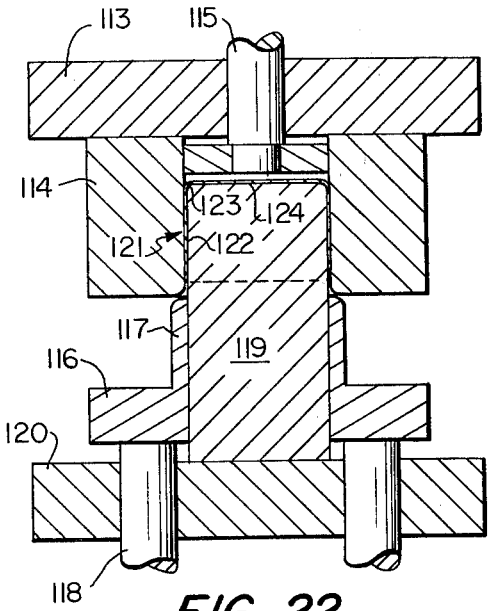

FIGS. 21 and 22 illustrate a second drawing operation. The second drawing operation is similar to that illustrated in FIGS. 3 and 4 in that the cup 109 is redrawn in the same direction as originally drawn. However, it should be clear to those skilled in the metal working art that the operation illustrated in FIGS. 21 and 22 may in actuality be a reverse redraw operation with the cup 109 being redrawn such that its outer surface then becomes its inner surface and its inner surface becomes its outer surface. It should also be clear that, with tooling designed in manners known to those skilled in the art, the drawing operation of FIGS. 19 and 20 and the redrawing operation of FIGS. 21 and 22, if performed as a reverse redraw operation could be accomplished in a single step by providing a punch within female die 102 and a hollow punch and die combination replacing punch 105.

As can be seen in FIGS. 21 and 22, an upper die set 113 has attached thereto a female die 114 and a knock out 115 located within the female die 114. The cup 109, as formed in FIG. 20, is mounted on a locator 117 of a draw ring 116. The draw ring 116 is, in turn, mounted upon pins 118 which may move vertically along their axes as did the pins 107 in FIGS. 19 and 20. A punch 119 is attached to a lower die set 120. As the upper die set 113 is lowered, the locator 117 contacts the female die 114 while the punch 119 and cup 109 enter the female die 114. As in FIGS. 19 and 20, the upper die set 113, the female die 114 and the draw ring 116 move downwardly so that the punch 119 and the cup 109 enter the female die 114, thus producing a cup 121 having a generally flat bottom wall 124, a curved or semi-torroidal transitional portion 123 and a generally cylindrical side wall 122. Unlike the embodiment of FIGS. 3 and 4, the cup 109 is driven into the female die 114 such that the cylindrical side wall 122 extends to the end of the cup 121, with no flange similar to the flange 23 shown in FIG. 4 being produced.

Figure 23:
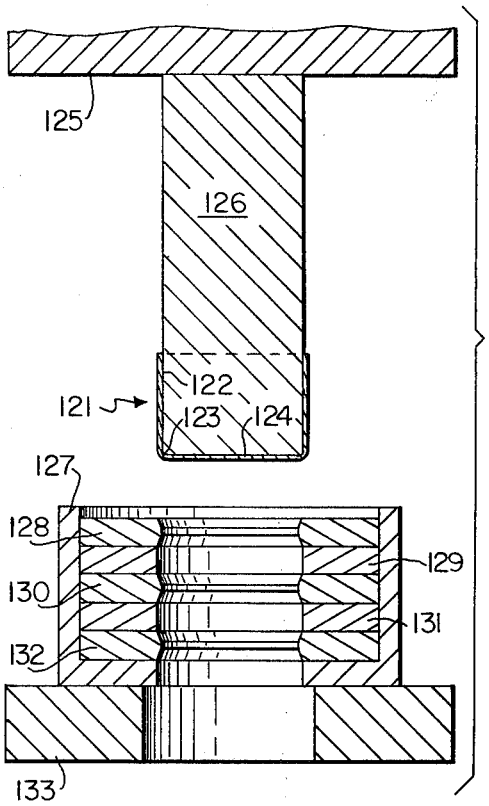
FIGS. 23 and 24 illustrate a one-step ironing operation.
Figure 24:
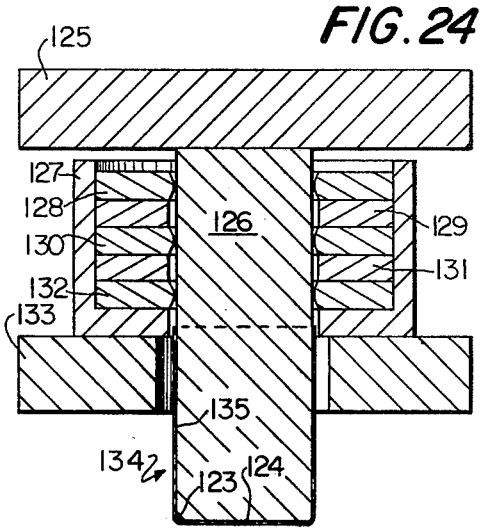

FIGS. 23 and 24 illustrate a one-step ironing operation, which may replace the three-step ironing operation illustrated in FIGS. 5–10.

Looking now at FIGS. 23 and 24, an upper die set 125 has attached thereto a punch 126. Cup 121, as produced in FIG. 22, is mounted upon the punch 126. A die holder 127 has a plurality of ironing dies 128, 130 and 132 mounted therein separated by separators 129 and 131. The die holder 127 is mounted on a lower die set 133.

As the upper die set 125 and punch 126 is lowered, cup 121 passes through the series of ironing dies 128, 130 and 132. Each of the ironing dies lengthens and thins the side wall 122. Thus, for example, the thickness of the side wall of the cup as it passes through ironing die 128 may range from about 0.009 to about 0.011 inches (0.022 to 0.028 centimeters), the thickness of the side wall as the cup passes through ironing die 130 may range from about 0.007 to about 0.009 inches (0.017 to 0.020 centimeters), and the thickness of the side wall as the cup passes through ironing die 132 may range from about 0.0045 to about 0.007 inches (0.011 to 0.017 centimeters). As the cup 134 exits the final ironing die 132, it includes thinned and lengthened side wall 135 having the generally flat bottom portion 124 connected thereto by means of transitional portion 123. The ironing operations do not affect either the transitional portion 123 or the bottom portion 124, which retain their original thicknesses.

Figure 25:
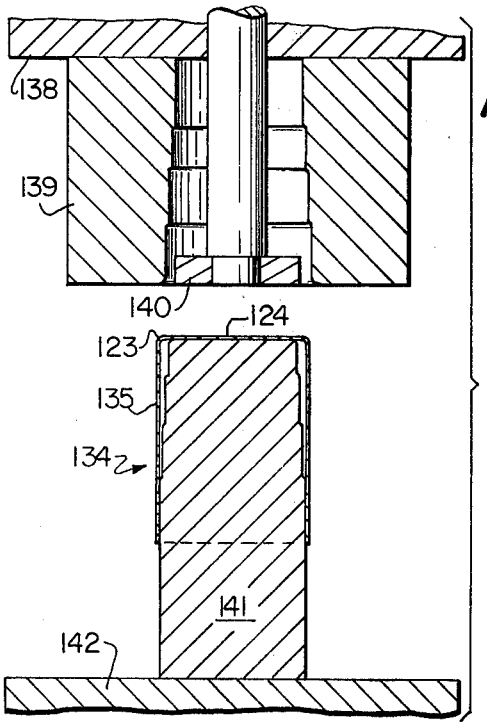
FIGS. 25 and 26 illustrate a first reforming operation.
Figure 26:
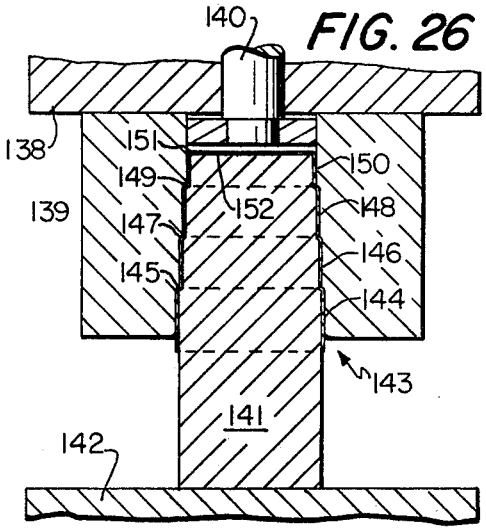

FIGS. 25 and 26 illustrate a first reforming or stuffing operation according to the modified embodiment of the present invention. An upper die set 138 has a female die 131 attached thereto and a knock out 140 located within the female die 139. A punch 141 is mounted on a lower die set 142 and has the cup 134, as produced in FIGS. 24, mounted thereon. As the upper die set 138 is lowered, and punch 141 and cup 134 enter the female die 139, the generally cylindrical side wall 135 is transformed into a series of stepped, generally cylindrical side wall portions 144, 146, 148 and 150. These side wall portions are connected by means of transitional portions 145, 147 and 149. The bottom wall 124 is converted to bottom wall 152. It is attached to side wall portion 150 by means of a transitional portion 151. The sidewall portion 150 and transitional portion 151 will be later transformed into a stacking ring during the final formation of the cup, as will be described below.

FIGS. 27 and 28 illustrate the transformation of the stepped side wall container 143 into tapered side wall container. A female die 154 having a tapered interior surface is mounted upon an upper die set 153 and includes a knock out 155 mounted therein. A punch 156 having a tapered exterior surface corresponding to the interior surface of female die 154 is mounted upon a lower die set 157, with the cup 143, as produced in FIG. 26, mounted thereon. As upper die set 153 is lowered and punch 156 and cup 143 enter the female die 154, cup 143 is transformed by a stuffing operation into container 158 having a tapered sidewall 159, a generally semi-torroidal transitional portion 160, a generally cylindrical stacking ring 161, a generally semi-torroidal transitional portion 162 and a generally flat bottom portion 163.

If desired, the container 158 may be employed as the final container. However, if a contoured bottom portion is desired, the bottom contouring steps illustrated in FIGS. 29 and 30 is employed. An upper die set 164 has a male bottom contour former 165 mounted thereon. The cup 158, as produced in FIG. 28, is mounted upon a punch 166 which includes a female bottom contour former 167 thereon. The punch 16 is mounted on a lower die set 170. As the upper die set 164 and male bottom former 165 are lowered, container 158, having the generally flat bottom portion 163, is transformed into container 168 having contoured bottom portion 169 formed therein.

As previously stated, the bottom contour may be any of typically known bottom contours, such as the "A", "E" or "V-100" bottoms.

It should again be noted that the bottom forming operation could be combined with the reforming operation, rather than being a separate step as illustrated.

From the foregoing, it is clear that the method of the present invention provides a nestable and stackable drawn and ironed can which both saves space in storage and is of the seamless variety.

While present preferred embodiments of the invention have been illustrated and described, it will be understood that the invention may be otherwise variously embodied and practiced within the scope of the following claims.

What is claimed is:

1. A method for producing a metallic container having a tapered side wall comprising drawing a metallic blank into a cup having a cylindrical side wall, ironing said side wall of said cup to thin and lengthen said side wall, forming said ironed side wall into transitional portions and reforming said transitional side wall portions into a tapered side wall.

2. The method of claim 1 wherein said forming comprises shaping said ironed side wall into stepped, generally cylindrical portions.

3. The method of claim 1 wherein said forming comprises shaping said ironed side wall into a tapered portion and a generally cylindrical portion.

4. The method of claim 1 further comprising contouring the bottom wall of said container.

* * * * *